US011534034B2

(12) United States Patent
Del Rosario

(10) Patent No.: US 11,534,034 B2
(45) Date of Patent: Dec. 27, 2022

(54) SMART SOAP

(71) Applicant: VIDA LUMINATIONS, INC., Los Angeles, CA (US)

(72) Inventor: Lee Del Rosario, Glendale, CA (US)

(73) Assignee: VIDA LUMINATIONS, INC., Glendale, CA (US)

( * ) Notice: Subject to any disclaimer, the term of this patent is extended or adjusted under 35 U.S.C. 154(b) by 0 days.

(21) Appl. No.: 17/074,339

(22) Filed: Oct. 19, 2020

(65) Prior Publication Data

US 2021/0212524 A1 Jul. 15, 2021

Related U.S. Application Data

(60) Provisional application No. 62/923,273, filed on Oct. 18, 2019.

(51) Int. Cl.
*A47K 5/12* (2006.01)

(52) U.S. Cl.
CPC ..... *A47K 5/1217* (2013.01); *A47K 5/1201* (2013.01)

(58) Field of Classification Search
CPC ..... A47K 5/1217; A47K 5/1201; A47K 5/12; B05B 11/00; C11D 17/046; C11D 17/08; G08B 21/245; B67D 3/0051
USPC ..... 222/23, 36, 80, 81, 87, 90
See application file for complete search history.

(56) References Cited

U.S. PATENT DOCUMENTS

| | | | | |
|---|---|---|---|---|
| 4,861,505 | A * | 8/1989 | Farman | C11D 17/048 206/77.1 |
| 5,971,827 | A * | 10/1999 | Lee | C11D 17/04 446/175 |
| 6,644,833 | B1 * | 11/2003 | Fu | C11D 17/0095 362/253 |
| 2009/0166378 | A1 | 7/2009 | Stilley | |
| 2016/0242601 | A1 * | 8/2016 | Del Rosario | C11D 17/08 |

* cited by examiner

*Primary Examiner* — Vishal Pancholi
*Assistant Examiner* — Robert K Nichols, II
(74) *Attorney, Agent, or Firm* — Buchalter, a Professional corporation

(57) ABSTRACT

Systems and methods are provided for a Smart Soap according to embodiments described herein. The Smart Soap may be incorporated into a system that includes any combination of the Smart Soap device, the retention tray, and remote electronic device. Exemplary embodiments may include a soap dispenser, soap dispenser with station, soap dispenser in communication with an electronic device, method of using the soap dispenser, and combinations thereof.

10 Claims, 5 Drawing Sheets

SMART SOAP

PRIORITY

The instant application claims priority to U.S. Provisional Patent Application No. 62/923,273, filed Oct. 18, 2019, which is incorporated by reference in its entirety herein.

BACKGROUND

Current hygiene products used to wash hands rely on the user's own education in hand washing techniques. Most individuals, especially children are poorly educated and uninformed in proper hand washing techniques. Such Individual are unreliable in offering accurate feedback when asked if they have properly washed their hands. Additionally, such individuals and their parents or guardians have no means of fully assessing their habits or lack thereof in a comprehensive and accurate manner.

There is currently no hand washing devise or system that tracks, stores, aggregates and distributes information of the hand washing actions of an individual.

The current method of washing hands does not record information or offer a reliable source to reveal if an individual has properly washed their hands.

SUMMARY

Washing hands properly, especially for children can be challenging. Children in particular have a dislike for washing their hands or they are uninformed/naive in proper hand washing techniques. According to the US Food and Drug Administration, a person should wash their hands for 20 to 30 seconds with soap and warm water to avoid spreading possible pathogens. Having a devise or system that electronically collects, stores, aggregates and distributes the information for each time an individual washes his/her hands, will help educate and raise awareness of the user's actions to help drastically decrease the spread of germs effectively avoiding the spread of sicknesses and viruses throughout common households, businesses, and schools, most of which are typically derived and passed through infants and children.

The Smart Soap module can collect and store the data each time a user's hands are washed. This data will then track if the individual has or has not washed their hands properly. The data is later analyzed and used to effectively teach and promote proper hand washing techniques through transmission of the date to mobile application to the end user.

DRAWINGS

DESCRIPTION

The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

The Smart Soap contains a micro-chip and sensors. The smart soap module may electronically collect, store, aggregate, distribute, or combinations thereof, the data collected from the user's actions and usage of the device after each session and transmit the same to a database via Bluetooth, WiFi, or other wired or wireless communication. The actions of the individual are recorded for each session the hands of the user are washed. The data may then be made available through an application for mobile or other devices for review and tracking by the end user.

Figure 1:
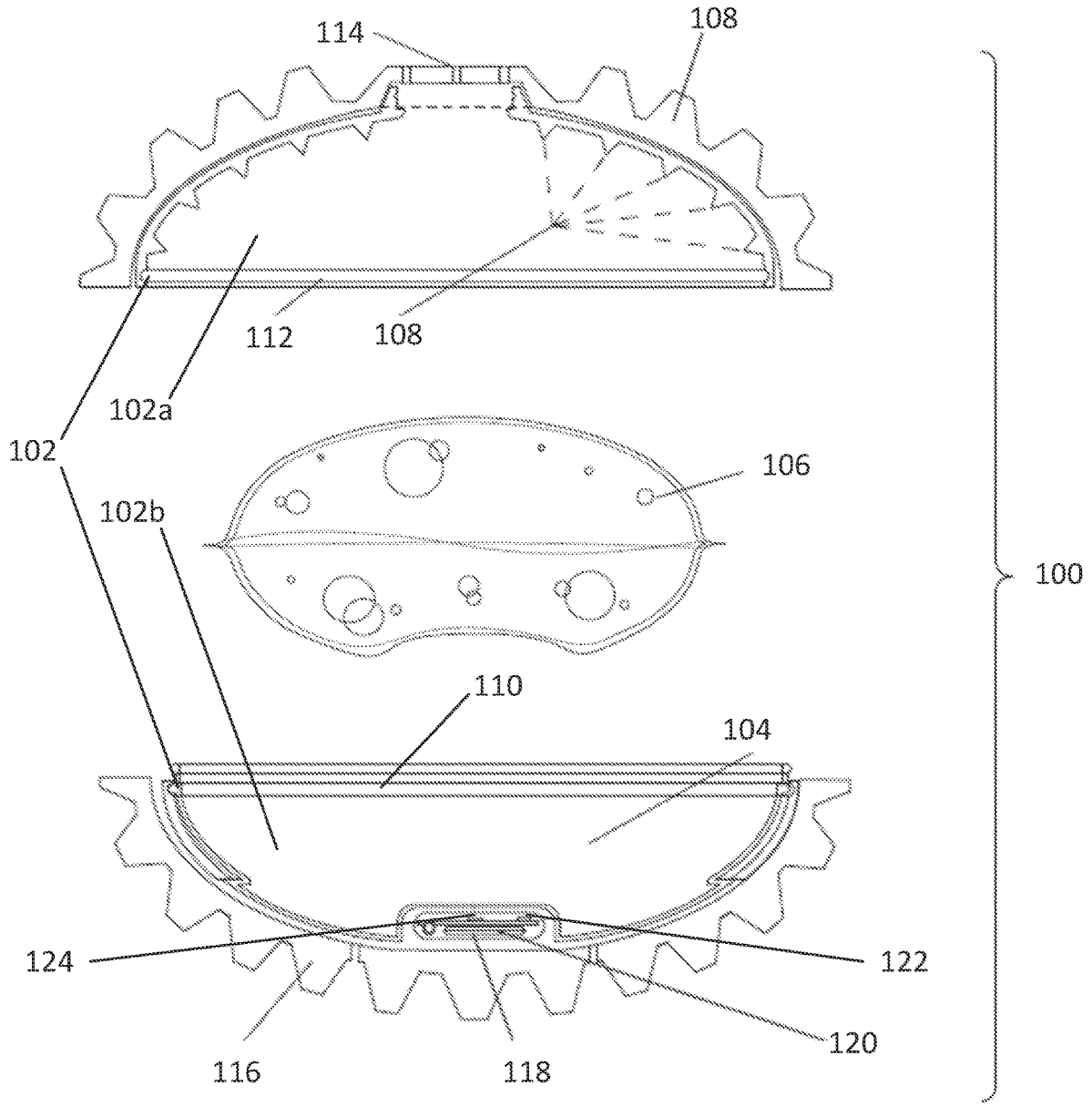
FIGS. 1-3 illustrate an exemplary schematic according to embodiments of the invention, including FIG. 1 as an exploded view taken in cross section, FIG. 2 as an assembled profile taken in cross section, and FIG. 3 as an exterior profile view.
Figure 2:
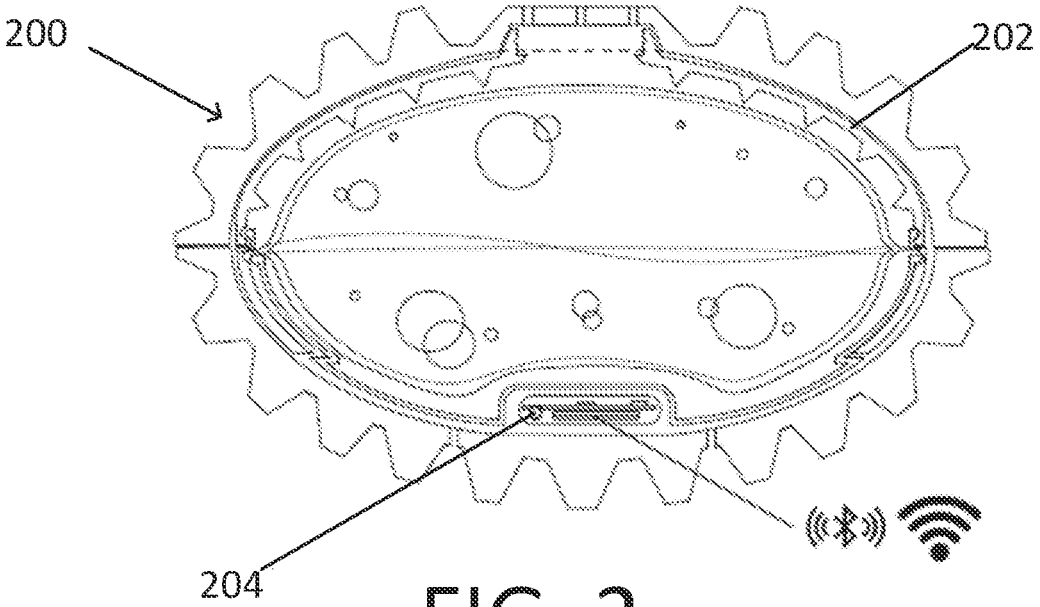
Figure 3:
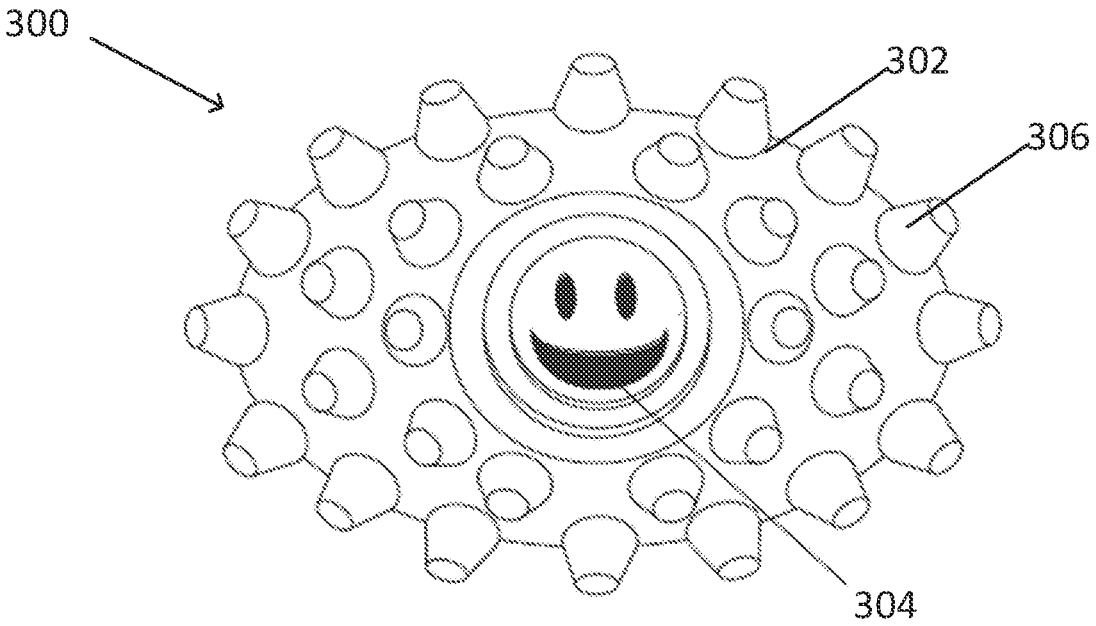

FIGS. 1-3 illustrate an exemplary schematic according to embodiments of the invention, including FIG. 1 as an exploded view taken in cross section, FIG. 2 as an assembled profile taken in cross section, and FIG. 3 an exterior profile view.

An exemplary embodiment of the Smart Soap dispenser is illustrated in FIG. 1. The dispenser 100 may include an inner shell 102. The inner shell 102 may be made of a single part or multiple parts (two parts 102*a* 102*b* are illustrated) that permit access to an interior cavity of the shell. The shell 102 defines an interior cavity 104 for retaining liquid soap. In an exemplary embodiment, the liquid soap may be inserted into the cavity using a soap pod 106 with an outer skin that dissolves or is punctured after being inserted into the cavity. For example, as seen in FIG. 1, an interior surface defining the interior cavity includes projections 108 facing toward an interior of the interior cavity 104. The projections 108 may extend a sufficient distance to contact and puncture a containing surface of a liquid soap pod 106 such that upon closure of the shell 102, the soap pod 106 is punctured, releasing the liquid soap. As indicated, the shell 102 may comprise a hard structure. The hard structure may be in comparison to the outer silicone skin 108. For example, the shell 102 may be flexible but deform less than the outer silicone skin 108 creating a support structure for the outer silicone skin. The shell may also be rigid such that it does not deform upon application of a scrubbing force typical in conventional hand washing.

In an exemplary embodiment of the dispenser 100, the two parts of the inner shell 102*a*, 102*b* may be removably attached. The two parts may be completely separable such as a top fully removed from the bottom, or may be coupled such that one portion moves relative to another to provide an opening to the interior cavity 104. The two parts 102*a*, 102*b* may be coupled by friction fit, screw fit, indent/detent, etc. The two parts may be hinged. The two parts may be latched or otherwise locked in a closed position. As seen in the exemplary embodiment of the separated cross-sectional profile of FIG. 1, the interior surface of one part of the shell may include a projection 110 that extends toward and contacts an interior surface of the other part of the shell and contacts a mated interior indentation feature 112, such that the protection and indentation mate to form a frictional locking engagement.

In an exemplary embodiment, the shell 102 includes a valve 114 to dispense the enclosed liquid soap from the interior cavity 104 to an outer surface thereof. The valve 114 may dispense liquid upon application and squeezing of the shell 102 to dispel the retained soap, the valve 114 may be opened and/or closed through contact with the valve, such as by pressing the valve. The valve 114 may include other configurations to intentionally dispel the soap during use, while retaining the soap in non-use. The valve 114 may be biased closed, and opened through intentional engagement with the dispenser 100 by a user.

FIG. 3 illustrates an exemplary image of embodiments of the dispenser 300 with an exterior skin 302 and valve 304 illustrated. In an exemplary embodiment, the dispenser 300 may include a skin 108, 302 to facilitate scrubbing and/or textured contact with the surface to be cleaned surface (e.g. hands). The skin 108, 302 may be textured and/or flexible to provide additional contact and frictional engagement to remove dirt, skin, and other contaminants. As illustrated, the textured surface includes a plurality of projections 116, 306. The skin also include a valve 304 for permitting the dispensed soap to pass through the skin and onto the hands of a user.

Figure 5A:
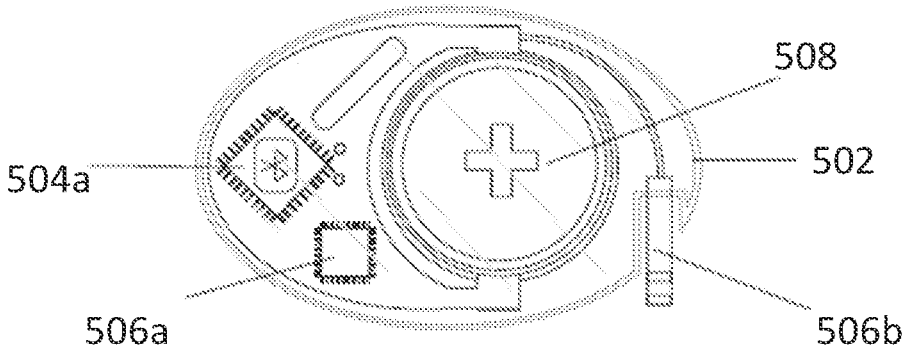
FIGS. 5A-5C illustrate exemplary system components according to embodiments described herein.
Figure 5B:
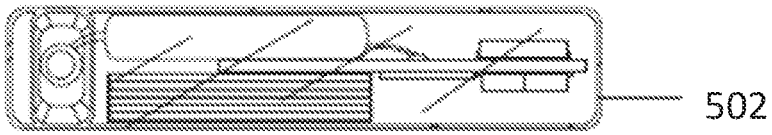
Figure 5C:
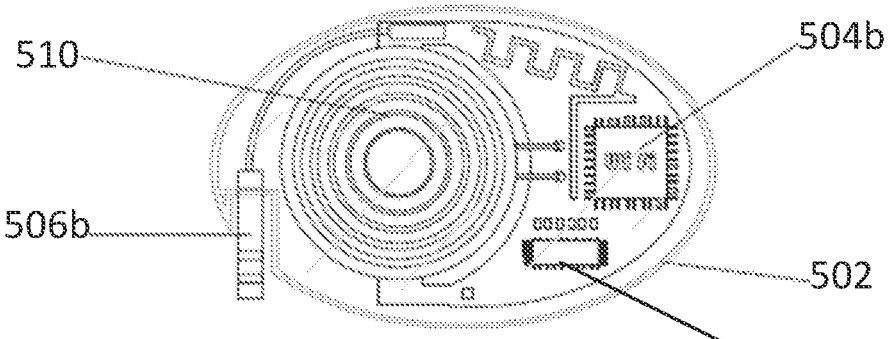

FIGS. 5A-5C illustrate an exemplary interior portion of the shell including electronic components of the dispenser. In an exemplary embodiment, the dispenser 100 includes a power source 118, 508, communication port 120, 504*a*, 504*b*, and sensor(s) 122, 506*a*, 506*b*. The dispenser 100 may also include a microchip or other processor 124, 512 for data handling. In an exemplary embodiment, the sensors 122, 506*a*, 506*b* may include any combination of accelerometer, vibration sensor, tilt sensor, proximity sensor, light sensor, gyroscope, temperature sensor, flow sensor, timer, and combinations thereof. The one or more combinations of sensors 122, 506*a*, 506*b* may be configured and/or used to receive and/or detect information about the dispenser 100 and/or its use. For example, the accelerometer, vibration sensor, title sensor, and/or gyroscope may be used to determine if the dispenser 100 is in use and engaged in a scrubbing action. A flow sensor and/or sensor for determining if the valve is open, such as a pressure sensor on the shell, or contact sensor on the valve, or other mechanism, and/or a timer, may be used to determine how much soap is dispelled during use. The sensors may be in combination with the dispenser 100 and/or any of its accessories, such as the charging, docking, or holding tray. For example, a pressure sensor may be incorporated into the holding tray to determine weight of the Smart Soap and may take a weight difference to determine how much soap has been used and/or how much soap remains before it must be refilled.

As seen in FIGS. 5A-5C, in an exemplary embodiment, the dispenser includes an interior housing 502. The interior housing 502 may include a waterproof plastic casing. The interior housing 502 may enclose a communication device 504*a*, 504*b*, one or more sensors 506*a*, 506*b*, and a power source 508. The communication device may be a wired port or wireless communication. For example, the communication device may include one or more of a Bluetooth chip, a WiFi chip, radio frequency chip, etc. The power source may be a rechargeable battery. For example, the dispenser may include a battery coupled to a charging induction coil. The one or more sensors may include any combination of accelerometer, vibration sensor, tilt sensor, proximity sensor, light sensor, gyroscope, temperature sensor, flow sensor, timer, and combinations thereof. The illustrated exemplary embodiment has a waterproof plastic casing 502 enclosing a Bluetooth chip 504*a*, a WiFi chip 504*b*, a rechargeable battery 508 coupled to an induction coil 510, and an accelerometer chip 506*a*. The system may also include a temperature sensor 506*b* configured to extend outside of the housing to receive temperature information through the housing. FIG. 5A illustrates a top cross sectional view; FIG. 5B illustrates a side cross sectional view; and FIG. 5C illustrates a bottom cross sectional view of the portion of the dispenser containing the electronics of the system.

Figure 4:
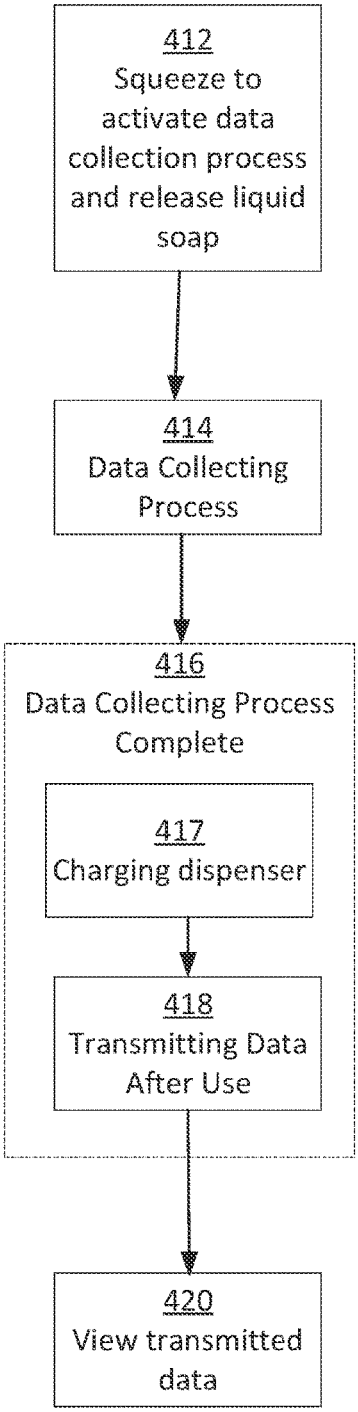
FIG. 4 illustrates an exemplary method of using the soap dispenser according to embodiments described herein.
Figure 4A:
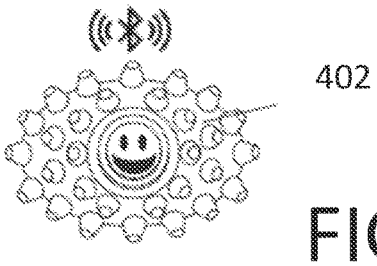
FIGS. 4A-4D illustrate representative soap dispenser, hands using the soap dispenser, the soap dispenser with station, the soap dispenser in communication with an electronic device according to the exemplary method of FIG. 4.
Figure 4B:
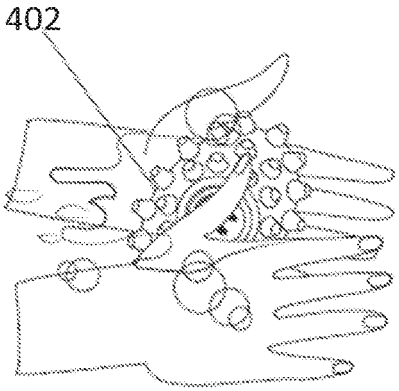
Figure 4C:
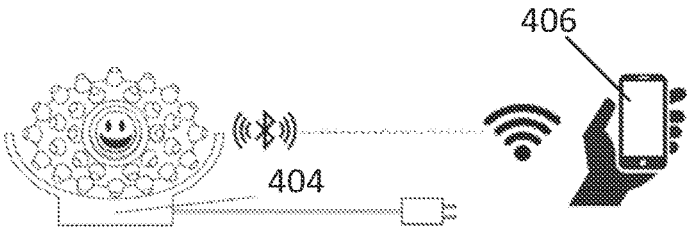
Figure 4D:
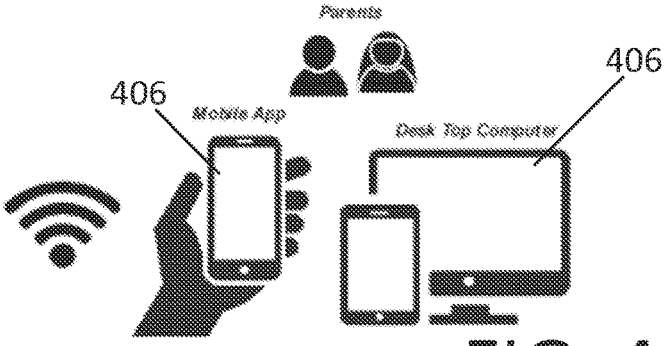

FIGS. 4, and 4A-4D illustrates an exemplary image of embodiments of a soap dispenser, soap dispenser with station, soap dispenser in communication with an electronic device, and method of using the soap dispenser. FIG. 4C represents an exemplary system and method for a dispenser 402 according to embodiments described herein. As illustrated, the dispenser 402 may be incorporated into a system that includes any combination of the dispenser 402 device, the retention tray 404, and remote electronic device 406.

Exemplary embodiments of the retention tray 404 may provide power to the dispenser 402, such as through wired or wireless charging of a rechargeable battery within the dispenser 402.

The retention tray 404 may include one or more sensor for detecting the presence of the dispenser 402 device. The retention tray 404 may include one or more sensors for detecting or determining an amount of soap remaining within the dispenser 402 device. The retention tray 404 may include one or more indicators. The indicators may be used to indicate whether the dispenser 402 is present, whether the dispenser 402 is charging, whether the dispenser 402 is charged, whether the dispenser 402 needs to be refilled or a level of soap within the dispenser 402 device, and combinations thereof.

The retention tray 404 may include a communication port for sending and receiving data to and/or from the dispenser 402 and/or to and/or from a remote electronic device 406. The communication port may be wired or wireless. The retention tray 404 may include a data processor for receiving, analysing, filtering, calculating, and determining based on the data received from the dispenser 402 device.

The remote electronic device 406 may be any computerized device such as a server, computer, smart phone, smart watch, tablet, etc. The remote electronic device 406 may be configured to send and receive data to or from the dispenser 402 device and/or retention tray. The remote electronic device 406 may include an application that is downloadable onto the electronic device that when executed by the processor performs the functions described herein. The application may also or additionally be executable or displayed from a web browser, such that a user may achieve the same functionality through a website. The application/website may be configured with a user interface for sending and receiving information to/from the user. The application/website may be configured to communicate, such as through a network, to a server, and/or the Smart Soap device, and/or the retention tray. The application/website may be configured to retrieve information based on the sensors from the Smart Soap device and/or retention tray. The application/website may permit a user to identify a specific Smart Soap device and/or retention tray. The identification may be through a unique identifier associated with the Smart Soap device and/or retention tray. The identification may be through proximity to an individual Smart Soap device and/or retention tray. The application/website may be configured to display information based on the retrieved information. The displayed information may include statistics about the Smart Soap device and/or its use, such as, for example, the detected motion, the duration of use, times of use, days and hours of use, water temperature, an amount of soap used, an amount of soap remaining, an amount of water used, and combinations thereof.

Exemplary embodiments may include a power or sensor start and/or stop indicator to conserver power. For example, the Smart Soap device may include a pressure sensor or other indicator for receiving an input from the user to turn the Smart Soap device on to activate data collection. For example, the Smart Soap device may include a proximity sensor for determining removal from the retention tray to turn the Smart Soap device on to activate data collection.

In an exemplary embodiment, the system may be configured to communicate with other applications such as to provide notices to refill or replay the liquid soap within the Smart Soap device, to purchase refills of the liquid soap such as through a purchasing assistant application, to provide notices of replacement of other components, etc.

The dispenser device, the retention tray, and/or the remote electronic device (such as a mobile device, computer, or computer server) may be used in any combination to receive, send, calculate, analyse, send, display data regarding the Smart Soap device, its use, contents, and combinations thereof. Each of the dispenser device, retention tray, and/or remote electronic device may include any combination of or all of the sensors, processors, communication, to perform any of the sensing, receiving, transmitting, obtaining, analysis, or other function described herein in any portion thereof.

As seen in FIG. 1, the assembly of the dispenser 100 may include two halves that snap together to form one module. The outer layer 108 comprises a textured silicone skin molded over a two half, hard plastic shell 102. The top plastic shell 102*a* can house a series of pointed teeth 108 designed to puncture a liquid soap pod 106 and houses a liquid soap-dispensing valve 114. Located on the inner bottom half of the plastic shell 102*b* is the Bluetooth microchip computer with sensors powered by a rechargeable battery.

The dispenser 100 may include two halves that snap together to form one module housing a liquid soap pod. The outer layers comprise a textured silicone skin molded over two one-half hard plastic shells designed to aid in the act of washing hands. Inside the plastic shell is a series of pointed teeth designed to puncture a liquid soap pod when the housing is squeezed which is later dispensed through a valve towards the top. The Smart Soap Bluetooth microchip computer has sensors powered by a rechargeable battery, which is housed on the inner bottom half of the plastic shell. FIG. 4 shows how the system functions when in use which includes the action of collecting several bits of data including the Motion, Time used, Days and Hours used, Water Temperature, How much soap used, How much water used, and combinations thereof.

The system functions when squeezed and when hands are being washed which tracks the actions of collecting several bits of data comprising Motion, Time used, Days and Hours used, Water Temperature, How much soap used, How much water used. After each use, this data is later transmitted from the Smart Soap via Bluetooth to any WiFi enabled Smart Phone or Desktop Computer. As illustrated by FIG. 4, the system may first be squeezed at step 412 to activate the data collection process and/or release liquid soap through the valve as described herein. At step 414, the system may be configured to collect data that may include any combination of the motion of the device, the time the device is used, the duration the device is used (the days and hours used), the water temperature), the amount of soap used, the amount of water used, and combinations thereof. When the data collection process is complete, at step 416, the dispenser 402 may be returned to the tray 404. At the tray 404, the dispenser 402 may be charged at step 417, and/or the data from the dispenser 402 may be communicated from the dispenser or the tray to the dispenser and/or to the remote electronic device. Thereafter, at step 420, the data may be viewed by a user on the remote electronic device.

Figure 6:
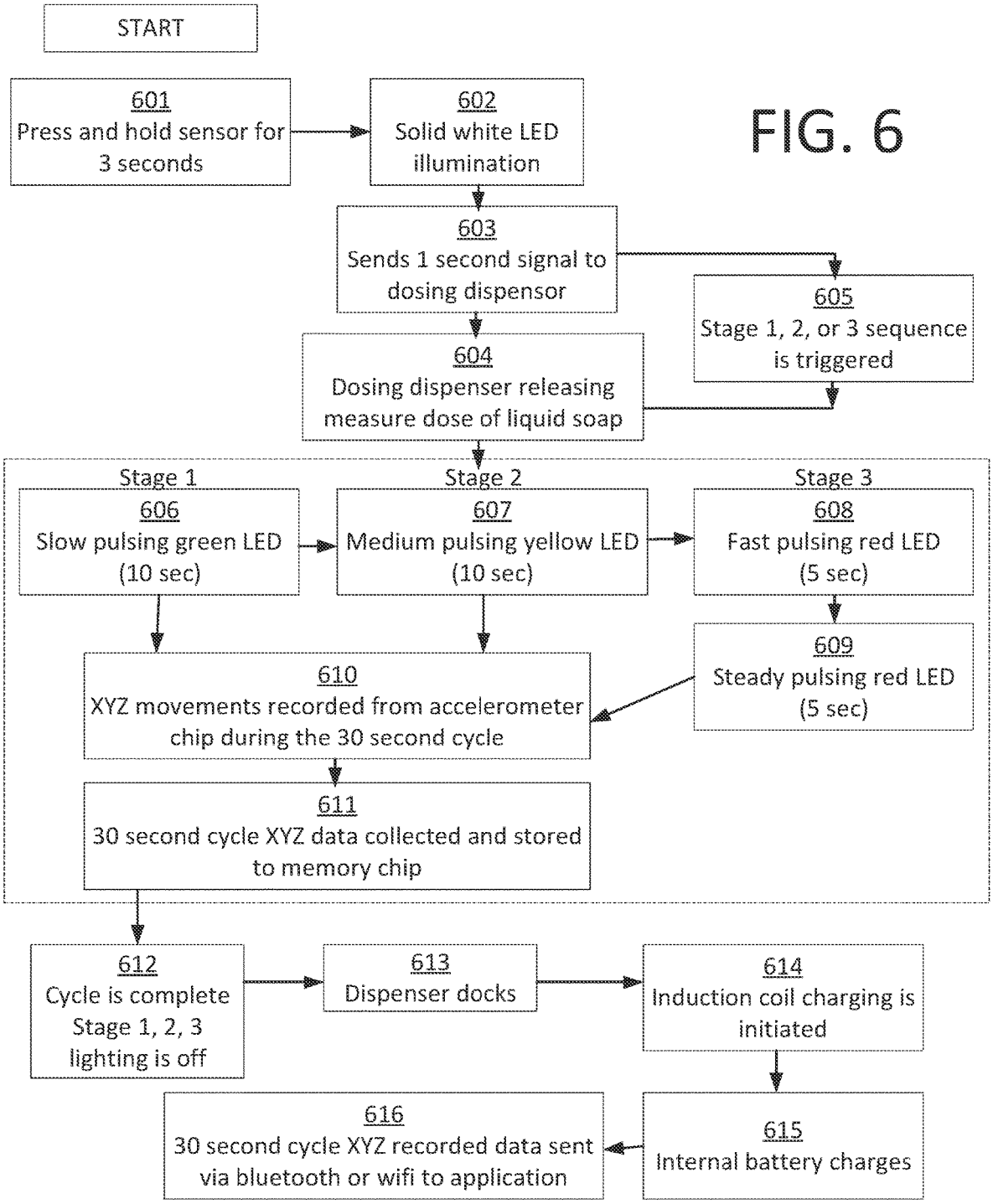
FIG. 6 illustrates an exemplary process diagram for an exemplary use case of an exemplary soap dispenser according to embodiments described herein.

FIG. 6 illustrates an exemplary process diagram for an exemplary use case of an exemplary soap dispenser according to embodiments described herein. The system may include an initiation mechanism. The system may, for example, automatically detect removal from the docking station, and/or in motion of the soap dispenser. The system may also include a user input, such as a pressure sensor (squeeze/button) that may activate the dispenser and/or features described herein. As illustrated at step 601, the user may engage the control input for a duration of time in order to distinguish an inadvertent control signal from an intentional control signal. The control mechanism may be on the soap dispenser, or part of the system, such as on the docking/charging/non-use station. If on a remote part of the system from the dispenser itself, the system may be configured to communicate the control signal to the dispenser. In an exemplary embodiment, the system may also have an indicator. The indicator may represent to a user a status of the system. For example, the system may include one or more colored lights that may be used in solid display and/or signalled or intermittent display to indicate a status of the system. Once the control signal is received to initiate the dispensing process, at step 602, the system may indicate the state of ready to dispense to provide notice to the user that the soap dispenser will dispense soap within a duration of time. In an exemplary embodiment, the duration is one second, but any duration may be used, such as a few seconds, 1-3 seconds, etc.

Once the control signal is received at the exemplary soap dispenser at step 603, the system may be configured to perform one or more functions. For example, the system may be configured to dispense soap from the soap dispenser for a desired duration, at step 604. The duration may be through the entire use of the dispenser during the scrubbing action or may be for a duration less than that. For example, the liquid may be dispensed for an amount of time or in amount of soap dispensed. In an exemplary embodiment, the soap dispenser may have one or more sensors for detecting an amount of time the dispenser is dispensing liquid and/or in the amount of liquid dispensed.

As the liquid is dispensed, the system may initiate the use action at step 605. The system may also be configured to initiate the use action after or at some time while the liquid is dispensed. In an exemplary embodiment, the method also includes conducting a use action. During the use action, the user uses the soap dispenser to scrub an object to be cleaned, such as their hands, fingers, nails, object, etc. During the use action, the system detects, through one or more sensors, a condition of the user. For example, at step 610, the movement through accelerometer and/or temperature may be received from one or more sensors. The system may be configured to record the received signals continuously or at a desired sample rate, or as averaged information from the sensors, to create a log of the activity. The information may be recorded for a desired duration at step 611. The desired duration, as illustrated, is 30 seconds. The desired duration may be set by a user depending on the intended cleaning action and/or object. The desired duration may be set by the system. The desired duration may be 30 seconds or may be up to 5 minutes or more. In an exemplary embodiment, the desired duration is 30 seconds to 2 minutes. The system may receive through a control input the desired object to be cleaned. The system may be configured to set a desired duration according to the user input of the object to be cleaned.

In an exemplary embodiment, the system may be configured to provide an indication to the user that the system is in the use cycle, steps 606, 607, 608, 509. The indication may be used to alert the user that data is being taken and/or recorded. The indication may be used to indicate an amount of time elapsed or an amount of time remaining within a use cycle. As illustrated, the use cycle is broken into three stages showing the initial use step 606, the warning coming close to end of use step 607, and the end of use notices, steps 608, 609. As illustrated, a combination of color and signal are used to identify a stage. The first stage may be of the first third of the cycle and may be indicated in a first color, such as green. The second stage may be of the second third of the cycle and may be indicated with a second color, such as yellow. The system may also change from solid to flashing or visa versa to indicate the change in stage. The third stage may be of the last third of the cycle and may be indicated with a third color. The last stage (whether one or more) may be indicated as a solid and/or flashing light. The last stage may be subdivided and may provide a progression through the stage, such as transitioning from solid indicator to a patterned (flashing indicator), and/or in change a frequency of the pattern. The system may provide the indication of the last stage with or without previous stages within the use cycle being indicated to the user.

In an exemplary embodiment, the system may locally record data from the sensor(s) on the soap dispenser during use at step 611. The system may then be configured to communicate the stored information to another portion of the system and/or to a remote electronic device, such as a user's mobile device at step 616. In an exemplary embodiment, the system may locally receive use data from one or more sensors and may transmit the information to be stored on another portion of the system remote from the soap dispenser (such as the receiving/charging/storing/etc. station). The other portion of the system may thereafter store received data and/or transmit all or a portion of the data to a user, such as through an application run on a user's mobile device.

Exemplary embodiments include a system having memory, processors, communication interfaces, and combinations thereof. The processors, memory, and communication interfaces may be on the smart soap device, holder, dispenser, or combinations thereof. The system may also include machine readable code stored in memory and configured to perform functions described herein. The machine readable code may be stored in the memory of the system and/or may be stored in the memory of a mobile device, separate from the smart soap dispenser. The smart soap system may be configured to communicate with and include the software application stored on a user's mobile device through the communication interface(s).

In an exemplary embodiment, once the system has completed the use cycle at step 612, the indicator turns off or provides a notice to the user that the cycle duration is complete. The user then returns the soap dispenser to the docking/charging/storage station at step 613. In an exemplary embodiment, the system may detect the presence of the soap dispenser on the station. In an exemplary embodiment, upon detection of the soap dispenser, the station may wirelessly charge the soap dispenser at step 614. In an exemplary embodiment, the station may use induction coil charge to charge an electronic device in proximity thereto at step 615. The electronic device may be the soap dispenser and/or the mobile device of the user.

In an exemplary embodiment, the dispenser functions when squeezed and when hands are being washed, tracking the action of collecting several bits of data including, Motion, Time used, Days and Hours used, Water Temperature, Soap Used, Water Used. This data may be stored locally at the Smart soap device and/or transmitted from the Smart Soap to any Wifi enabled Smart Phone or Desktop Computer or other electronic device, such as the charging/docking station. Transmission from the Smart Soap may be through any wired or wireless path, such as Bluetooth, Radio Frequency, WiFi, cable, etc.

Exemplary embodiments of the system described herein can be based in software and/or hardware. While some specific embodiments of the invention have been shown the invention is not to be limited to these embodiments. For example, most functions performed by electronic hardware components may be duplicated by software emulation. Thus, a software program written to accomplish those same functions may emulate the functionality of the hardware components in input-output circuitry. The invention is to be understood as not limited by the specific embodiments described herein, but only by scope of the appended claims.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A smart soap system comprising a soap dispenser having a housing defining a cavity, a valve in communication with the housing operable to permit liquid soap dispensing from the cavity to an exterior of the housing, a power supply, an accelerometer, a temperature sensor, a processor, and a tray, wherein the processor is configured to receive input from the accelerometer and the temperature sensor and track information including a time in use of the smart soap system and a temperature during the time in use of the smart soap system.

2. The smart soap system of claim 1, further comprising a communication interface between the soap dispenser and the tray.

3. The smart soap system of claim 2, wherein the system is configured to communicate the tracked information from the soap dispenser to the tray.

4. The smart soap system of claim 1, wherein the system is configured to communicate the tracked information to a remote electronic device.

5. The smart soap system of claim 4, further comprising an application configured to be downloaded and stored on the remote electronic device and when executed by a processor of the remote electronic device configured to display the tracked information to a user through a display of the remote electronic device.

6. The smart soap system of claim 5, wherein the soap dispenser further comprises an induction coil configured to interact with the tray and recharge the power supply.

7. A method of using a smart soap system, comprising:

providing a soap dispenser having a housing, a power supply, a sensor, processor, and a communication interface;

providing a tray for holding the soap dispenser when the soap dispenser is not in use, the tray and soap dispenser configured to electronically communicate;

using the soap dispenser to wash hands;

using the processor of the soap dispenser and an input from the sensor to track a use duration of the soap dispenser.

8. The method of claim 7, further comprising communicating the use duration from the soap dispenser to a remote electronic device.

9. The method of claim 8, further comprising using an induction coil within the soap dispenser to recharge the power supply of the soap dispenser with the tray.

10. The method of claim 9, wherein the soap dispenser further comprises a second sensor for measuring a temperature, and the method further comprises using the processor of the soap dispenser and an input from the second sensor to track a temperature during the use of the soap dispenser.

* * * * *